US008943621B2

(12) United States Patent
Wang

(10) Patent No.: US 8,943,621 B2
(45) Date of Patent: Feb. 3, 2015

(54) SUCTION DEVICE FOR ENHANCING THE NEGATIVE PRESSURE OF THE SIPHON OF THE TOILET AND THE METHOD THEREOF

(75) Inventor: Bing Wang, Xiamen (CN)

(73) Assignee: Xiamen R&T Plumbing Technology Co., Ltd., Xiamen (CN)

( * ) Notice: Subject to any disclaimer, the term of this patent is extended or adjusted under 35 U.S.C. 154(b) by 691 days.

(21) Appl. No.: 13/185,697

(22) Filed: Jul. 19, 2011

(65) Prior Publication Data

US 2012/0174307 A1 Jul. 12, 2012

(30) Foreign Application Priority Data

Jan. 7, 2011 (CH) ..... 2011 2 0004086 U

(51) Int. Cl.
*E03D 1/06* (2006.01)
*E03D 1/34* (2006.01)

(52) U.S. Cl.
CPC ..... *E03D 1/34* (2013.01); *E03D 2201/30* (2013.01)
USPC ..... 4/370

(58) Field of Classification Search
CPC ..... A47K 4/00; E03D 1/08
USPC ..... 4/300–442
See application file for complete search history.

(56) References Cited

U.S. PATENT DOCUMENTS

D261,975 S * 11/1981 Sauls ..... D7/332
4,922,557 A * 5/1990 Harding et al. ..... 4/477
5,232,232 A * 8/1993 Kishi ..... 280/43.1
5,647,074 A * 7/1997 White et al. ..... 4/664
5,970,914 A * 10/1999 Steil et al. ..... 119/165
6,402,338 B1 * 6/2002 Mitzel et al. ..... 362/154
6,418,672 B1 * 7/2002 Hampel ..... 52/79.1
D497,210 S * 10/2004 Averett et al. ..... D25/33
6,823,639 B2 * 11/2004 Hampel ..... 52/598
7,135,035 B1 * 11/2006 Dimmick ..... 607/90
8,079,096 B2 * 12/2011 Roberts ..... 4/476
2002/0046422 A1 * 4/2002 Perett ..... 4/524
2003/0024191 A1 * 2/2003 Hampel ..... 52/309.1
2004/0163335 A1 * 8/2004 Hampel ..... 52/143
2007/0283488 A1 * 12/2007 Birdsall ..... 4/622
2008/0210141 A1 * 9/2008 Hampel ..... 108/57.33
2009/0077729 A1 * 3/2009 McLeod ..... 4/300
2009/0100585 A1 * 4/2009 Roberts ..... 4/317
2009/0211002 A1 * 8/2009 Norgaard ..... 4/111.1
2009/0235445 A1 * 9/2009 Goldstein ..... 4/462
2011/0186100 A1 * 8/2011 Bolin ..... 135/121
2011/0289671 A1 * 12/2011 Westrick ..... 4/476
2012/0102635 A1 * 5/2012 Cheng ..... 4/476

FOREIGN PATENT DOCUMENTS

CN 201065573 Y 5/2008
CN 201065573 Y * 5/2008

* cited by examiner

*Primary Examiner* — Lori Baker
(74) *Attorney, Agent, or Firm* — Rabin & Berdo, P.C.

(57) ABSTRACT

A method of enhancing the negative pressure of siphon of toilet is to suck the air between the two traps to enhance the negative pressure between the two seal-water, so as to rapidly form a siphon in the traps and flush the waste out rapidly. A suction device for enhancing the negative pressure of siphon of a toilet is used. It comprises: a water container installed in the water tank, said water container is provided with a water inlet and outlet; an air container with an opening in the bottom installed inside the water container, the lower portion of the side wall of the air container has a water opening connected to the water container; and a connecting tube, the bottom of which is connected to the trapway of the toilet, and the top is connected to the top of the air container.

14 Claims, 7 Drawing Sheets

SUCTION DEVICE FOR ENHANCING THE NEGATIVE PRESSURE OF THE SIPHON OF THE TOILET AND THE METHOD THEREOF

FIELD OF THE INVENTION

The present invention relates to a suction device, more particularly, to a suction device for enhancing the negative pressure of the siphon of the toilet.

BACKGROUND OF THE INVENTION

CN201065573Y disclosed a dual water-sealed and negative pressure toilet, wherein, an upper trap 3, which is positioned in a bucket body 1 and is connected with the lower port of a urinal 2, is connected with a lower trap 5 via a down drain tube 4, the lower trap 5 is connected downwards with a down drain outlet 6 via the drain tube 4; the upper trap 3 is connected with the lower trap 5 via the down drain tube 4. The utility model is characterized in that a down water seal is added on the basis of one water seal in the siphon toilet to form dual water seal and dual siphon, thus has the advantages of smell isolation, water saving, splash prevention, noise prevention; But the dual water-sealed and negative pressure toilet has the following problems: because there is air existing in the drain tube 4 between the upper trap 3 and lower trap 5, if the toilet is needed to be drained, the water must overcome the air pressure in the drain tube 4, by extending the flush time to add the water quantity to the urinal 2, thus siphon can be produced between the upper trap 3 and lower trap 5 so as to let the waste in the urinal 2 to be siphoned to the down drain outlet 6, so the water-saving is not very well in this toilet.

SUMMARY OF THE INVENTION

The primary object of the present invention is to provide a suction device for enhancing the negative pressure of the siphon of the toilet, thus to obviate the disadvantages existed in the prior toilet that the siphon is not enough and the water saving is not well. By suck out the air between the two traps, the negative pressure between the two traps is enhanced, thus the traps can form siphon rapidly and the waste can be drained out rapidly.

The object of the present invention is achieved by providing: a suction device for enhancing the negative pressure of the siphon of the toilet, comprising a water container installed in the water tank, the water container is provided with a water inlet and a water outlet; an air container with an opening in the bottom is fixedly installed inside the water container, the opening of the air container is in or close to the bottom of the water container, the lower portion of the side wall of the air container has a water opening connected to the water container; a connecting tube, the bottom of which is connected to the trapway of the toilet, and the top is connected to the top of the air container.

Said water inlet is set in the side wall or bottom of the water container; preferredly, the water inlet is in the side wall of the water container, water of the water tank is flowed into the water container through the water inlet, then the water level of the water container is rise, the water level of the air container which connected with the water container via the water opening is rise also, the air in the top portion of the air container is then be pressed to the trapway via the connecting tube by the rising water lever, when the air pressure in the trapway is rise to a certain pressure, the air will be overflow to the drain tube via the lower trap.

The water outlet is the installation hole for the flush valve in the bottom of the water container, the water opening of the air container is near by the water inlet. The water container and the water tank can be connected together by the flush valve via the water outlet, and the water level of the water container can be fall by the water drainage from the water outlet controlled by the flush valve.

Another object of the present invention is to provide a method for enhancing the negative pressure of the siphon of the toilet, comprising an air container with an opening in the bottom, said air container is installed inside the water container, the lower portion of the air container is provided with an water opening connected to the water container; a connecting tube, the bottom of which is connected to the trapway of the toilet, and the top is connected to the top of the air container. The water level of the air container is rise or fall with the rising or falling of the water level of the water container, or, the water level of the water container is rise or fall with the rising or falling of the water level of the air container, when the water in the water tank is drain out, the falling water level of the air container will produce a negative pressure in the air container, the connecting tube connected with the air container will suck air from the trapway of the toilet, then the trapway will produce an air negative pressure to enhance the pressure difference between the two terminals of the upper trap, i.e. the negative pressure of the trapway is rise so that less flushing water will produce siphon, thus to achieve water saving.

Said water container is a water tank of the toilet or a water container with a water inlet and a water outlet installed in the water tank.

The present invention has the following advantages: when the suction device of the present invention is mounted in the water tank of the toilet, if the water outlet of the water container is drained, the water levels of the water container and the air container will fall, negative pressure will formed in the top portion of the air container so that the air in the trapway of the toilet will be suck to the air container via the connecting tube, and the siphon toilet will produce an air negative pressure to enhance the pressure difference between the two terminals of the upper trap, i.e. the negative pressure of the trapway is rise so that less flushing water will produce siphon rapidly, and the waste can be drained out rapidly, thus to achieve water saving.

In these figures: 10 water container; 11 water inlet; 12 water outlet; 13 locating hole; 14 flange; 20 air container; 21 water opening; 22 gap; 23 single side wall; 24 installation hole for flush valve; 30 connecting tube; 40 plug; 50 strip; 60 toilet; 61 upper trap; 62 lower trap; 63 trapway; 64 suction tube; 70 water tank; 80 fill valve; 90 flush valve.

DETAILED DESCRIPTION OF THE PREFERRED EMBODIMENTS

Preferred embodiment of the present invention will be described in detail with reference to the drawings and examples; Understanding that these drawings depict only typical embodiments of the invention and are not therefore to be considered to be limiting of its scope.

Figure 1:
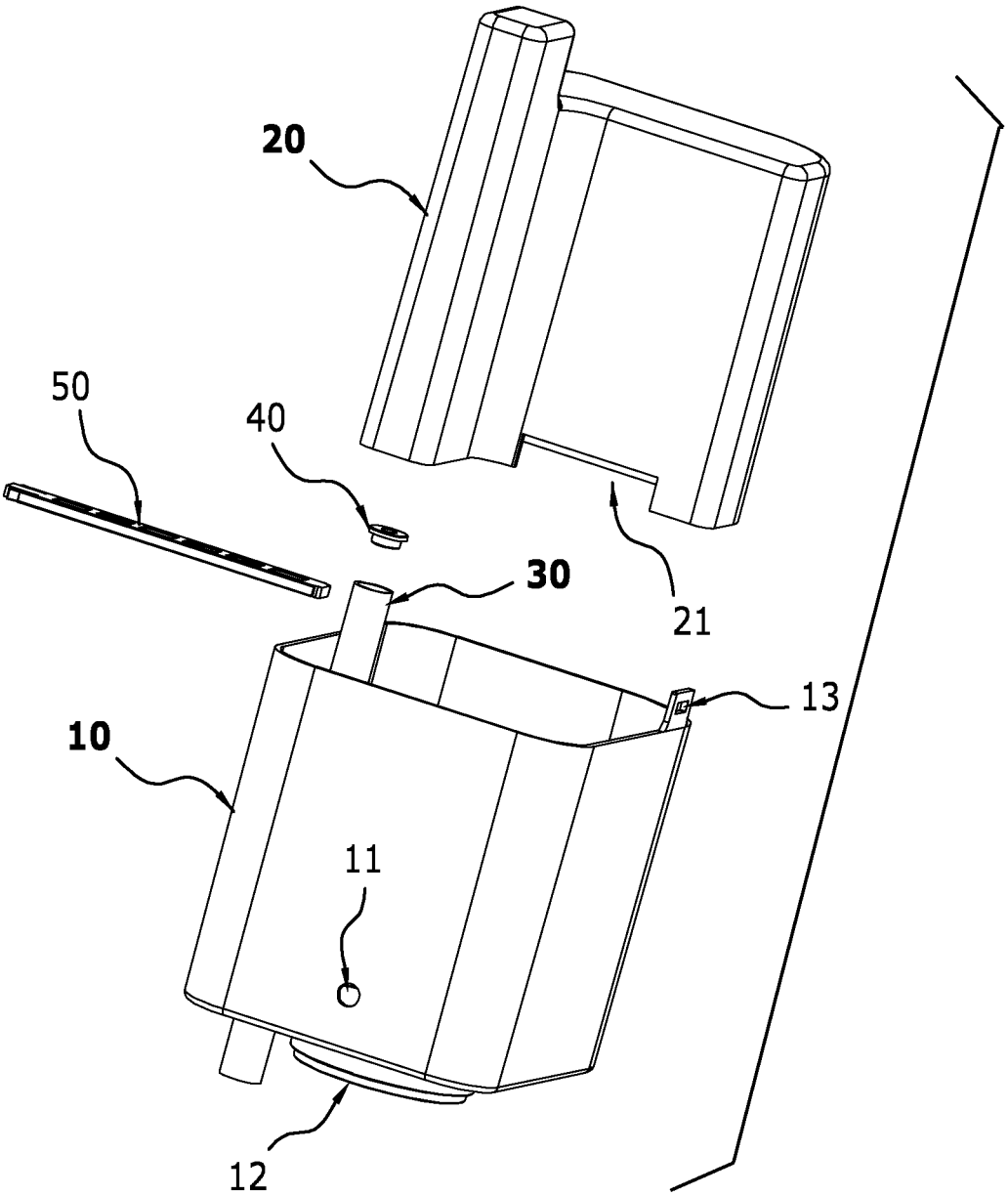
FIG. 1 is an exploded view of the present invention in embodiment 1.
Figure 2:
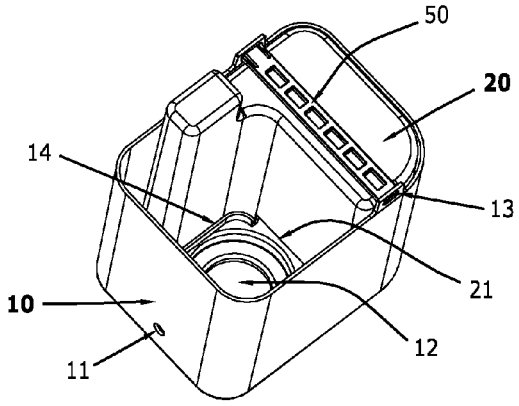
FIG. 2 is a perspective view of the present invention in embodiment 1.
Figure 3:
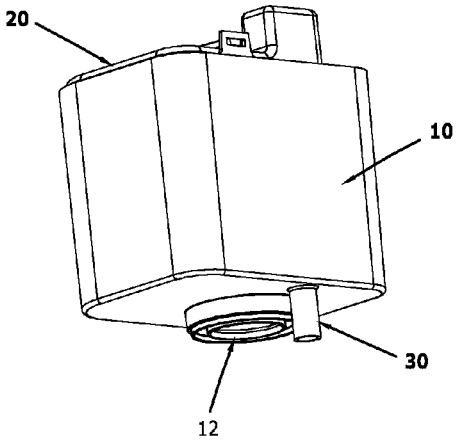
FIG. 3 is another perspective view of the present invention in embodiment 1.

Embodiment 1: referring to FIG. 1 to FIG. 3, Suction device for enhancing the negative pressure of the siphon of the toilet of the present invention mainly comprising: a water container 10, an air container 20, a connecting tube 30, an adjusting plug 40 and a strip 50.

Figure 4:
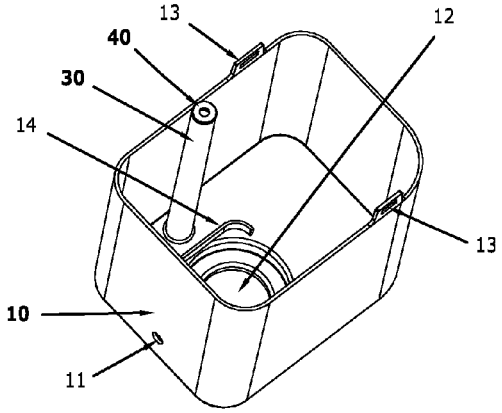
FIG. 4 shows the connection between the water container and the connecting tube in embodiment 1.
Figure 5:
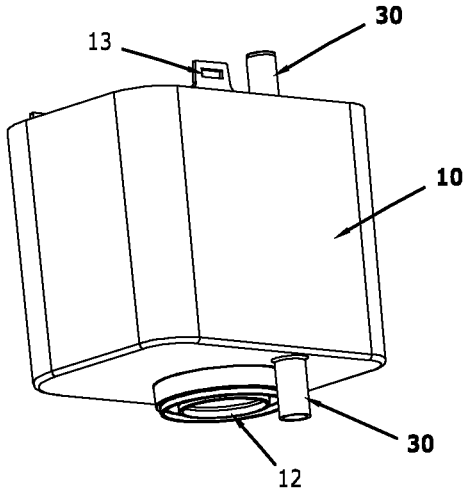
FIG. 5 is another view shows the connection between the water container and the connecting tube in embodiment 1.
Figure 6:
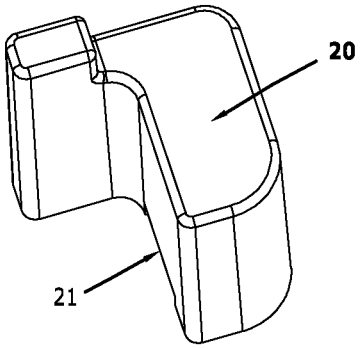
FIG. 6 is a perspective view of the air container in embodiment 1.
Figure 7:
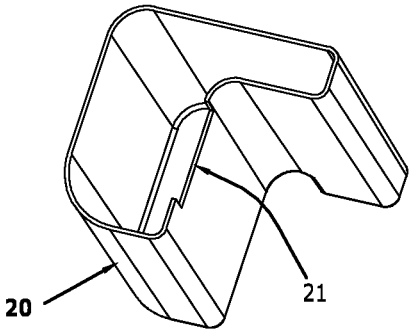
FIG. 7 is another perspective view of the air container in embodiment 1.
Figure 9:
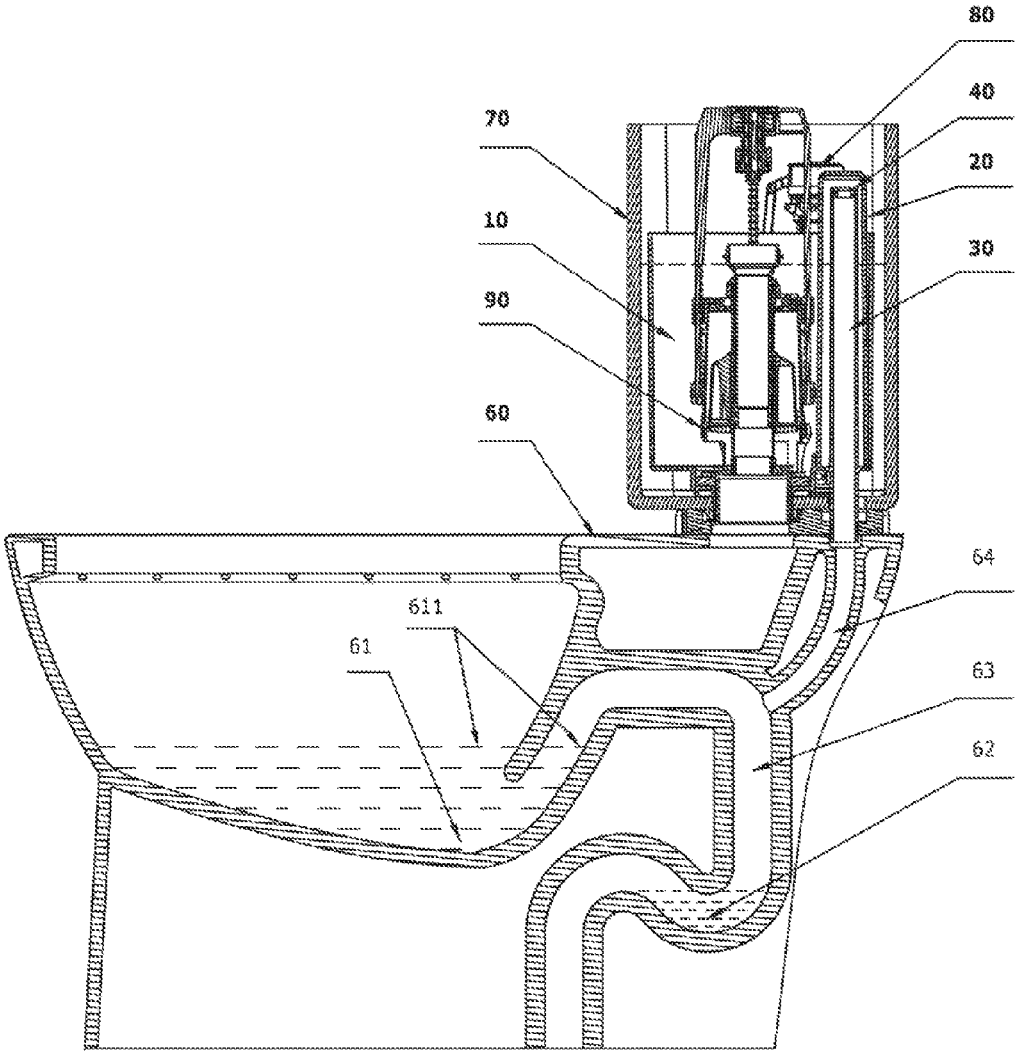
FIG. 9 is a sectional view which shows the device of the present invention in embodiment 1 installed in toilet with dual traps.

As shown in FIG. 6 and FIG. 7, the air container 20, which is bottom-opened, hollow-inside, and with an L-shaped section, has a water opening 21 in bottom flange. as is shown in FIG. 4 and FIG. 5, the water container 10 which can be mounted inside the water tank of a toilet 60 can be opened, so that is convenient to be mounted with the valve and the connecting tube, an water outlet 12 is provided in the bottom of the opened water container 10, the lower portion of the side wall of the water container 10 is provided with a water inlet 11 which is connected with the water tank, the bottom around the water outlet 12 near the water outlet 12 has a flange 14, when the air container is inserted into the water container, the fit clearance between the lower portion of the side wall near the water outlet 12 of the air container 20 and the water container 10 will be sealed by the flange 14, but the water opening 21 of the air container 20 will not be blocked. connecting tube 30 is inserted in the bottom of the water container 10, a plug 40 for adjusting the air flow is mounted on the top end of the connecting tube 30, the top end of the connecting tube 30 can be inserted into the highest position of the inside of the air container 20, and the bottom of the connecting tube 30 pass through the bottom of the container 10 is connected to the trapway 63 of the toilet 60, as shown in FIG. 9 Each of the opposite side walls of the water container 10 has a locating hole 13 respectively, a strip 50 is mounted and press on the top of the air container 20 installed in the water container 10, and the two ends of the strip 50 can be fixedly inserted into the locating holes 14.

As shown in FIG. 1 to FIG. 3, the air container 20 is installed inside the water container 10, the fit clearance between the lower portion of the side wall of the air container 20 and the water container 10 is sealed by the flange 14, while the water opening 21 of the air container 20 is connected to the water container 10; the water outlet 12 is disposed in the bottom of the water container 10, between the water container 10 and the air container 20. The connecting tube 30 of the water container 10 is inserted to the air container 20, the top end of the connecting tube 30 is disposed in the top portion of the inside of the air container; the strip 50 is mounted on the top of the air container and pressed on it, and the two ends of the strip 50 are fixedly inserted into the locating holes 14, thus the invention is assembled. The above water container 10 can be the water tank of the toilet.

Figure 8:
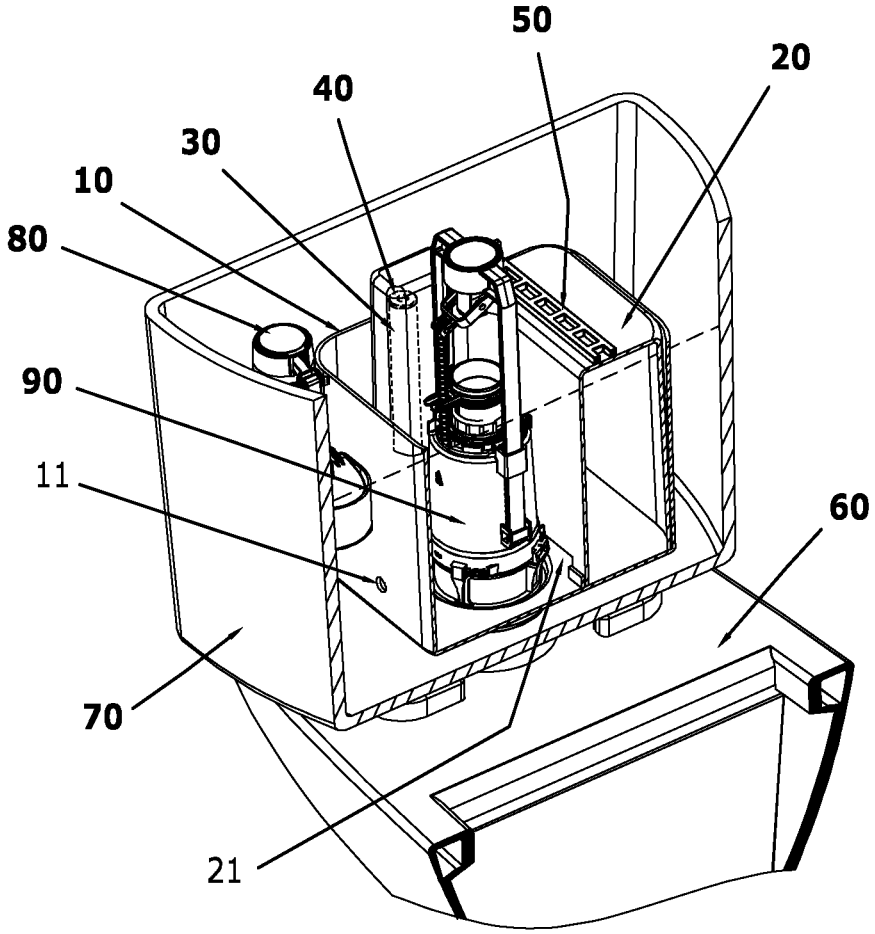
FIG. 8 is a sectional view which shows the device of the present invention in embodiment 1 installed in the water tank.

Referring to FIG. 8 and FIG. 9, the suction device is mounted into the water tank 70 of a toilet 60 with dual traps, the water container 10 is connected to the water tank 70 by the flush valve 90, and the connecting tube 30 is connected to the trapway 64 of the toilet 60. The principle and the process will be more detailedly described in the following description.

Open the fill valve 80, the water from a water supply will be filled into the water tank 70, and then flow into the water container 10 via water opening 21, as the water level of the air container 20 is rise, the water in the water container 10 will flow into the air container 20 via the opening 21. As the water level of the air container 20 rise, the water in the air container 20 will press the air in the air container 20, the air then is pressed into the trapway 63 between the upper trap 61 and lower trap 62 via the connecting tube 30 and the suction tube 64. when the air pressure is rise to a certain point, the air is get out to the drain pipe through the lower trap 62, when the water in the water tank 70 is reach to predetermined level (a working status), the water flowing into the water tank 70 is stopped, accordingly, the rise of the water levels of the water container 10 and air container 20 is stopped, and the water level of the air container 20 is a little lower than the top of the connecting tube 30.

When the flush valve 90 is opened, the water in the water tank 70 and water container 10 will flush to the toilet 60 through the water outlet 12, then the water level in the water container 10 fell, and the water level in the air container 20 also fell because the water is flow to the water container 10 via water opening 21. the falling water level of the air container 20 make the inside chamber of the air container 20 suck the air in the trapway 63 between the upper trap 61 and lower trap 62 through the plug 40, connecting 30 and suction tube 64 of the toilet 60, thus a negative pressure is formed in the trapway 63, and siphon will be more quickly formed by the negative pressure. Compared to prior toilet in background, if the present suction device is applied, a negative pressure will be take to the traps when flush the toilet, thus less water will bring a big suction power and form siphon more quickly, the waste in the toilet 60 will be quickly drained out to the drain pipe connected to the toilet.

Figure 10:
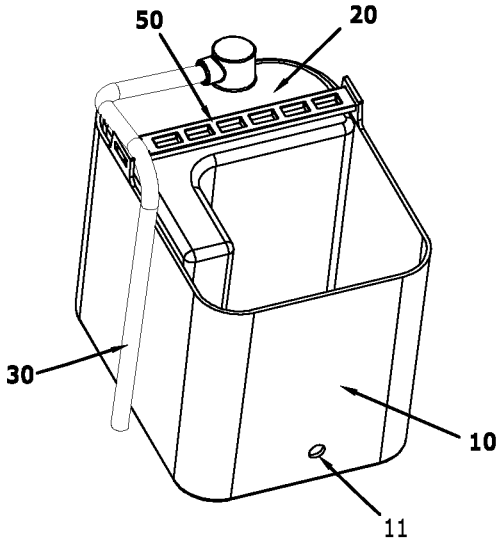
FIG. 10 is a perspective view of the present invention in embodiment 2.
Figure 11:
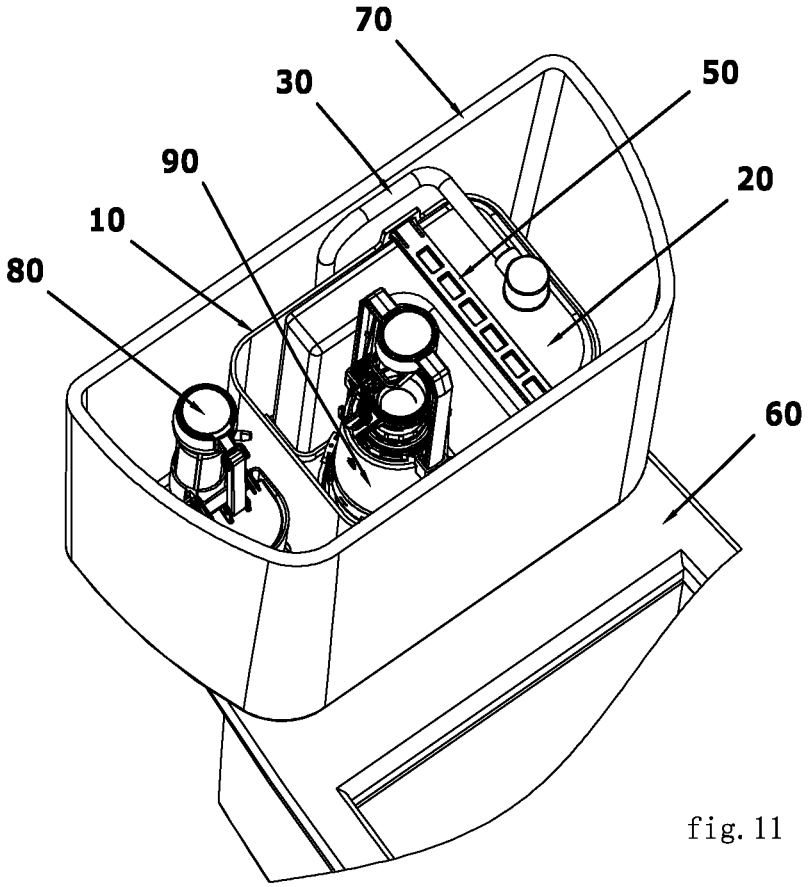
FIG. 11 shows the device of the present invention in embodiment 2 installed in the water tank.

Embodiment 2: referring to FIG. 10 and FIG. 11, the difference of the embodiment 2 to embodiment 1 is that: in embodiment 1, the connecting tube is mounted in the air container 20 to let the structure to be compact; in this embodiment the connecting tube 30 is mounted outside the air container 20, the top end of the connecting tube 30 is connected into the air container 20 at the top, the plug 40 on the top end of the connecting tube 30 thus can be conveniently be adjusted to avoid that in each time the air flow in the connecting tube 30 needed to be adjusted, the air container 20 must be disassembled from the water container 10; the other connecting structure, principle and process are the same as embodiment 1.

Embodiment 3

Figure 12:
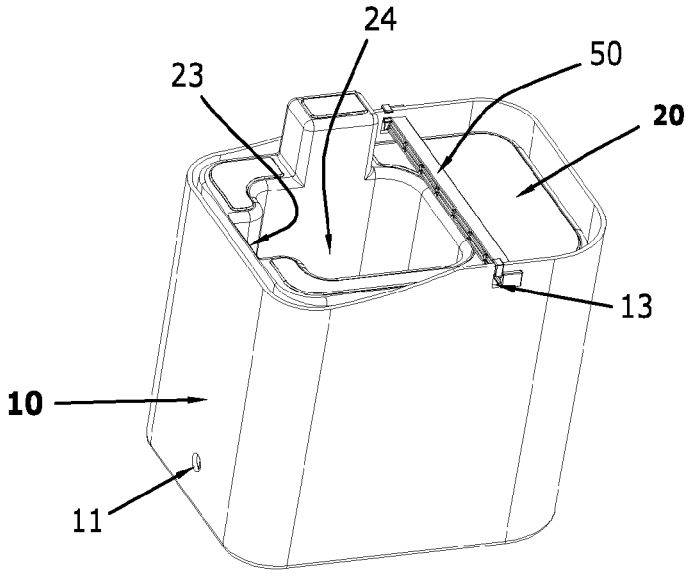
FIG. 12 is a perspective view of the present invention in embodiment 3.
Figure 13:
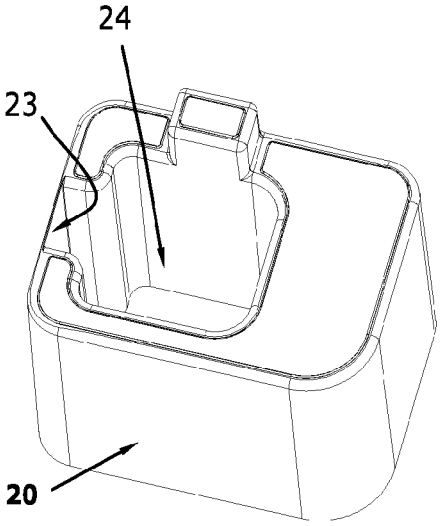
FIG. 13 is a perspective view of the air container in embodiment 3.
Figure 14:
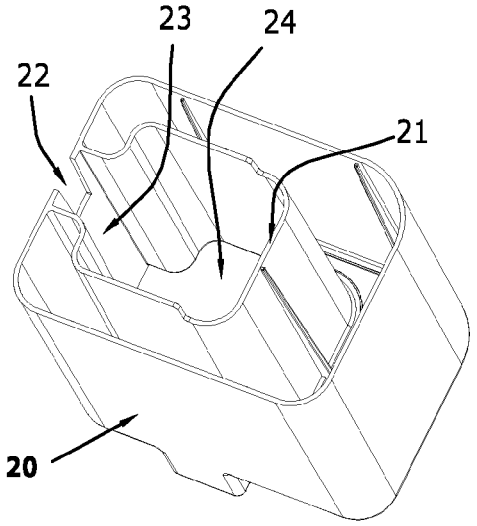
FIG. 14 is another perspective view of the air container in embodiment 3.

Referring to FIG. 12 to FIG. 14, the difference to embodiment is that: the air container 20 is a dual annular sleeve with a hole 24 for inserting flush valve in the middle, the dual annular sleeve has a single side wall 23, on which an gap 22 connected to the water inlet 11 of the water container 10 is disposed, the air container 20 is sleeved to the water container 10, the gap 22 of the air container 20 is connected to the water inlet 11 of the water container 10 and the hole 24 of the flush valve, the opening 21 of the air container 20 is disposed in the bottom of the side wall of the hole 24, when water is filled into the water tank, the water is flow into the water container 10 via the water inlet 11 and gap 22, and then flow into the air container 20 via opening 21; the other connecting structure, principle and process are the same as embodiment 1.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with detailed description, but rather by the claims appended hereto.

What is claimed is:

1. A suction device for enhancing the negative pressure of the siphon of the toilet, comprising:

a water container installed in the water tank, said water container is provided with a water inlet and a water outlet;

a bottom-opened air container, said air container is disposed inside said water container and the opened end is downwardly, the lower portion of a side wall of the air container has a water opening connected to the water container; and a connecting tube, the bottom of which is connected to the trapway of the toilet, and the top is connected to the top of the air container.

2. The suction device for enhancing the negative pressure of the siphon of the toilet according to claim 1, wherein said water container is top-opened, the bottom of said air container is close to the bottom of said water container.

3. The suction device for enhancing the negative pressure of the siphon of the toilet according to claim 2, wherein said water inlet is disposed in the side wall or bottom of said water container.

4. The suction device for enhancing the negative pressure of the siphon of the toilet according to claim 3, wherein said water outlet is a installation hole for installing a flush valve in the bottom of the water container, the water opening of the air container is near the water inlet.

5. The suction device for enhancing the negative pressure of the siphon of the toilet according to claim 4, wherein a bottom around the water outlet of said water container corresponding to the bottom of said air container is provided with flange for blocking water.

6. The suction device for enhancing the negative pressure of the siphon of the toilet according to claim 5, wherein a cross section of said air container is L-shaped, and the outlet is disposed at the bottom of said water container between said L-shaped air container and water container.

7. The suction device for enhancing the negative pressure of the siphon of the toilet according to claim 5, wherein the air container is a dual annular sleeve with a hole for installing flush valve in the middle, said dual annular sleeve has a single side wall, on which a gap connected to the water inlet of said water container is arranged, said air container is sleeved in said water container, said gap of said air container is connected to the water inlet of said water container and the hole for the flush valve, the opening of said air container is disposed at the bottom of the side wall of the hole.

8. The suction device for enhancing the negative pressure of the siphon of the toilet according to claim 5, wherein each of the two opposite side walls of the water container has a locating hole respectively, a strip is mounted and pressed on the top of said air container, and the two ends of the strip can be fixedly inserted into the locating holes.

9. The suction device for enhancing the negative pressure of the siphon of the toilet according to claim 2, wherein a plug for adjusting the air flow is mounted on the top end of said connecting tube.

10. The suction device for enhancing the negative pressure of the siphon of the toilet according to claim 2, wherein said connecting tube is inserted into the bottom of the water container and is inserted into said air container, the bottom end of said connecting tube is extended below the bottom of said water container, and the top of said connecting tube is in the top portion of the inside of said air container.

11. The suction device for enhancing the negative pressure of the siphon of the toilet according to claim 2, wherein said connecting tube is mounted outside said air container, the top end of said connecting tube is connected into the air container at the top.

12. A method for enhancing the negative pressure of a siphon of a toilet is characterized in that a suction device for enhancing the negative pressure of siphon of a toilet is used, said suction device comprising:

a water container installed in the water tank, said water container is provided with a water inlet and a water outlet;

a bottom-opened air container, said air container is disposed inside said water container and the opened end is downwardly; and a connecting tube, the bottom of which is connected to the trapway of the toilet and the top is connected to the top of the air container;

wherein, the water level of said air container rises or falls with the rising or falling of the water level of the water container, when the water in the water tank drains out, the falling water level of said air container produces a negative pressure in said air container, said connecting tube connected with the air container sucks air from the trapway of the toilet, thus causing said trapway to produce an air negative pressure that enhances the pressure difference between the two terminals of the upper trap.

13. The method for enhancing the negative pressure of siphon of a toilet according to claim 12, wherein the lower portion of said air container includes a water opening communicating to said water container.

14. The method for enhancing the negative pressure of siphon of a toilet according to claim 12, wherein said water container is top opened; the bottom of said air container is close to the bottom of said water container.

* * * * *